US005252788A

United States Patent [19]

Emrick et al.

[11] Patent Number: 5,252,788

[45] Date of Patent: Oct. 12, 1993

[54] STAMP FORMED MUFFLER WITH IN-LINE EXPANSION CHAMBER AND ARCUATELY FORMED EFFECTIVE FLOW TUBES

[75] Inventors: James W. Emrick; Bruno A. Rosa, both of Toledo, Ohio

[73] Assignee: AP Parts Manufacturing Co., Ohio

[21] Appl. No.: 866,753

[22] Filed: Apr. 10, 1992

[51] Int. Cl.[5] ..... F01N 7/18

[52] U.S. Cl. ..... 181/282

[58] Field of Search ..... 181/228, 238, 239, 241, 181/243, 249, 250, 251, 268, 269, 272, 273, 282

[56] References Cited

U.S. PATENT DOCUMENTS

| | | |
|---|---|---|
| 705,357 | 7/1902 | Keating . |
| 1,110,040 | 9/1914 | Chatain . |
| 2,484,826 | 10/1949 | Harley . |
| 2,484,827 | 10/1949 | Harley . |
| 2,658,580 | 11/1953 | Trembley . |
| 2,860,722 | 11/1958 | Gerstung . |
| 2,902,109 | 9/1959 | Burgess et al. . |
| 2,943,695 | 7/1960 | Jeffords . |
| 3,125,182 | 3/1964 | Earley . |
| 3,140,755 | 7/1964 | Travel . |
| 3,158,222 | 11/1964 | Richmond . |
| 3,176,791 | 4/1965 | Betts et al. . |
| 3,198,284 | 8/1965 | Powers . |
| 3,220,508 | 11/1965 | Nordquest et al. . |
| 3,412,825 | 11/1968 | Hall . |
| 3,638,756 | 2/1972 | Thiele . |
| 3,650,354 | 3/1972 | Gordon . |
| 3,709,320 | 1/1973 | Höllerl et al. . |
| 3,827,529 | 8/1974 | Frietzsche et al. . |
| 3,852,041 | 12/1974 | Moore et al. . |
| 4,108,274 | 8/1978 | Snyder . |
| 4,109,751 | 8/1978 | Kabele . |
| 4,132,286 | 1/1979 | Hasui et al. . |
| 4,165,798 | 8/1979 | Martinez . |
| 4,396,090 | 8/1983 | Wolfhugel . |
| 4,415,059 | 11/1983 | Hayashi . |
| 4,418,790 | 12/1983 | Agnew . |
| 4,422,519 | 12/1983 | Nomura et al. . |
| 4,456,091 | 6/1984 | Blanchot . |
| 4,523,660 | 6/1985 | Gaddi . |
| 4,700,806 | 10/1987 | Harwood . |
| 4,736,817 | 4/1988 | Harwood . |
| 4,759,423 | 7/1988 | Harwood et al. . |
| 4,760,894 | 8/1988 | Harwood et al. . |
| 4,765,437 | 8/1988 | Harwood et al. . |
| 4,809,812 | 3/1989 | Flugger . |
| 4,821,840 | 4/1989 | Harwood et al. . |
| 4,836,330 | 6/1989 | Harwood et al. . |
| 4,847,965 | 7/1989 | Harwood et al. . |
| 4,860,853 | 8/1989 | Moring, III . |
| 4,894,987 | 1/1990 | Harwood et al. . |
| 4,901,815 | 2/1990 | Harwood et al. . |
| 4,901,816 | 2/1990 | Garey . |
| 4,905,791 | 3/1990 | Garey . |
| 4,909,348 | 3/1990 | Harwood et al. . |
| 4,928,372 | 5/1990 | Harwood et al. . |
| 4,941,545 | 7/1990 | Wilcox et al. . |
| 5,004,069 | 4/1991 | Van Blaircum et al. . |
| 5,012,891 | 5/1991 | Macaluso ..... 181/282 |
| 5,042,125 | 8/1991 | Harwood et al. . |

FOREIGN PATENT DOCUMENTS

| | | |
|---|---|---|
| 59-155528 | 9/1984 | Japan . |
| 59-43456 | 12/1984 | Japan . |
| 60-111011 | 6/1985 | Japan . |
| 61-14565 | 5/1986 | Japan . |
| 61-108821 | 5/1986 | Japan . |
| 61-155625 | 7/1986 | Japan . |
| 632013 | 1/1950 | United Kingdom . |
| 1012463 | 12/1965 | United Kingdom . |
| 2120318 | 11/1983 | United Kingdom . |

OTHER PUBLICATIONS

NACA Report 1192—Theoretical and Experimental Investigation of Mufflers with comments on Engine--Exhaust Muffler design by Don D. Davis, Jr. et al., 1953.

*Primary Examiner*—Michael L. Gellner

*Assistant Examiner*—Khanh Dang

*Attorney, Agent, or Firm*—Anthony J. Casella; Gerald E. Hespos

[57] ABSTRACT

An exhaust muffler is provided with first and second internal plates formed to define an array of tubes and a reversing chamber. A pair of external shells are engaged to the internal plates and define one or more chambers surrounding the tubes defined by the internal plates. A pipe extends across the reversing chamber defined by the internal plates and to the outlet. A portion of the pipe may be perforated to enable expansion of exhaust gas into a high frequency tuning chamber.

14 Claims, 5 Drawing Sheets

STAMP FORMED MUFFLER WITH IN-LINE EXPANSION CHAMBER AND ARCUATELY FORMED EFFECTIVE FLOW TUBES

BACKGROUND OF THE INVENTION

The typical prior art exhaust muffler includes a plurality of discrete parallel tubes supported by transversely extending baffles. The tubes and baffles are disposed in a separate tubular outer shell. An outer wrapper may be disposed over the tubular outer shell to dampen vibrations in the shell. Headers or end caps are then affixed to the opposed ends of the tubular outer shell and the wrapper to substantially enclose the opposed ends of the prior art muffler. Each header or end cap of the prior art muffler has at least one aperture to which an exhaust pipe or a tail pipe of a vehicular exhaust system is mounted. Chambers are defined in this prior art muffler by the outer shell and a pair of spaced apart baffles or by the outer shell, one baffle and an end cap or header of the muffler. The tubes of the prior art muffler are disposed and configured to provide communication with the respective chambers. In particular, selected areas of certain tubes may be perforated or louvered to permit an expansion of exhaust gas into the surrounding chamber. Other tubes will terminate or start in a chamber. The particular arrangement and dimensions of components in this prior art muffler are selected in accordance with the acoustical characteristics of the exhaust gas flowing through the muffler, back pressure specifications recommended by the vehicle manufacturer and space limitations on the underside of the vehicle.

A typical prior art muffler is shown in FIG. 10 and is identified generally by the numeral 10. The prior art muffler 10 often is referred to as a tri-flow muffler and includes an inlet tube 12 and outlet tube 14. The inlet tube 12 is supported by an end cap 16 and by baffles 18 and 20 respectively. The outlet tube 14 is supported in parallel relationship to the inlet tube 12 by transverse baffles 18, 20, 22 and 24 and by the end cap 26. A perforated return tube 28 also is supported by the transverse baffles 18 and 20 in generally parallel relationship to the inlet and outlet tubes 12 and 14. A tuning tube 30 is supported by the baffles 22 and 24 and is also parallel to the inlet and outlet tubes 12 and 14. A tubular outer shell 32 encloses the above described end caps and baffles 16–26 and the tubes supported thereby. An outer wrapper 34 is engaged around the shell 32 to minimize vibration and to thereby avoid the shell ring noise associated with such vibrations.

As noted above, the various components of the prior art tri-flow muffler 10 are disposed in accordance with the particular acoustical characteristics of the exhaust gas flow for the vehicle on which the prior art tri-flow muffler 10 is mounted. In this regard, the exhaust gas enters the prior art muffler 10 through the inlet tube 12 and will expand through the perforations 36 to communicate with the expansion chamber 38 defined between the baffles 18 and 20. A substantial portion of the exhaust gas will continue to flow into the reversing chamber 40 defined between the baffles 20 and 22 of the prior art muffler 10. The expansion of exhaust gas enter the reversing chamber contributes to noise attenuation. The amount of attenuation and the frequencies for which attenuation occurs depends in part upon the expansion ratio which relates the cross-sectional dimensions of the tube with the cross-sectional dimensions of the chamber. The tube and chamber dimensions can be selected (to the extent permitted by other design constraints) to achieve a preferred expansion ratio and hence a preferred attenuation. The rapidly flowing exhaust gas creates substantial pressure on the walls of the reversing chamber 40. The forces generate movement and vibration in the baffles 20 and 22 and the shell 32 of the prior art muffler 10 as the gases undergo the 180° change in direction. However, the internal disposition of the reversing chamber 40 insulates and thus dampens any shell ring that could be generated by movement of the walls defining reversing chamber 40. The tuning tube 30 of the prior art muffler 10 is aligned with the inlet tube 12 for an efficient "driven" tuning effect, and then extends into a low frequency resonating chamber 42. The dimensions of the tuning tube 30 and the volume of the low frequency resonating chamber 42 are selected to attenuate a particular narrow band of low frequency noise that may not be adequately attenuated by the other components of the prior art muffler. It will be noted that the low frequency resonating chamber 42 is a dead end chamber. As a result the exhaust gas entering the reversing chamber 40 will flow over and under the outlet tube 14 to enter the return tube 28. Thus, the exhaust gas undergoes a 180° change in direction between the inlet and return tubes. The perforations 44 in the return tube 28 will enable a communication of exhaust gas with the expansion chamber 38. However, a substantial portion of the exhaust gas will continue through the return tube 28 and into the second reversing chamber 46 and from there into the outlet tube 14. The outlet tube 14 is provided with an array of perforations 48 in the expansion chamber 38. As a result, exhaust gas will flow into the outlet tube 14 from both the reversing chamber 46 and the expansion chamber 38. The outlet tube 14 further includes an array of perforations 50 which enable communication with a high frequency tuning chamber 52 defined by the baffles 22 and 24. The perforations 50 and the high frequency tuning chamber 52 both are dimensioned to attenuate a narrow range of high frequency noise that is not adequately attenuated by the other components of the muffler. The exhaust gas will continue through the outlet tube 14 and will communicate with a tail pipe welded or otherwise connected to the outlet tube 14 in proximity to the end cap 26.

Mufflers like the prior art tri-flow muffler 10 of FIG. 10 generally perform well. Despite the efficient performance, however, it will be noted that the prior art muffler 10 requires twelve components which must be assembled in a labor intensive manufacturing process. The assembled prior art muffler 10 must then be connected to the exhaust pipe and tail pipe of the exhaust system by welding or by clamps which generally require additional labor intensive manufacturing steps. The prior art muffler 10 further includes several functional disadvantages. In particular, the abrupt sharp edges of the tubes in the prior art muffler 10 result in less then optimum noise attenuation for at least certain narrow frequency bands, and may generate a secondary "flow noise" within the prior art muffler 10. Similar undesirable results are attributable to the sharp corners and parallel walls defined within the respective chambers of the prior art muffler 10. The prior art muffler 10 may also be difficult to tailor to a particular vehicle within a class of related vehicles. For example, certain vehicles within a class of related vehicles may not require the high frequency tuning chamber 52. However, the removal of the baffle 22 or 24 and the elimination of the perforations 50 necessarily will alter the noise attenuation characteristics of either the low frequency resonating chamber 42 or the reversing chamber 40. Similarly, it may be difficult to alter the low frequency resonating characteristics achieved by the tuning tube 30 and the low frequency resonating chamber 42 without affecting other performance characteristics of the prior art muffler 10. Similarly, if a second low frequency resonating chamber and tuning tube combination were required for a particular vehicle within a class of related vehicles, a substantial re-design of the entire prior art muffler 10 may be required.

Mufflers formed at least in part from stamped components have been available for many years. The typical prior art stamp formed muffler includes a pair of internal plates stamped with channels. The internal plates are secured to one another such that the channels define an array of tubes, portions of which may be perforated, louvered or otherwise configured to permit expansion of exhaust gas from the tubes. The typical prior art stamped muffler will further include a pair of stamp formed external shells surrounding and communicating with the tubes. Stamp formed mufflers generally require many fewer components than the conventional mufflers described and illustrated above. Furthermore, stamp formed mufflers can be manufactured in processees that are well suited for a high degree of automation. Until recently, however, the prior art stamp formed mufflers were not completely effective in attenuating the full range of noise associated with the flow of exhaust gas. In particular, the typical prior art stamp formed muffler had merely included perforated tubes passing through one or more expansion chambers. There was no accommodation for the narrow ranges of low frequency noise or high frequency noise that may not have been adequately attenuated by the simple combination of a perforated tube passing through an expansion chamber. Examples of prior art mufflers of this general type include U.S. Pat. No. 3,140,750 which issued to Tranel on Jul. 14, 1964 and U.S. Pat. No. 4,396,090 which issued to Wolfhungel on Aug. 2, 1984. U.K. Published Patent Application No. 2,120,318 shows a stamp formed tri-flow muffler with reversing chambers at opposed ends of the muffler and an expansion chamber therebetween.

Some prior art mufflers have included short conventional tubular components and/or separate baffles in combination with various stamped components in an effort to enhance the tuning options, and thereby improve the acoustical performances of the muffler. An example of a tri-flow muffler formed with both stamped and conventional tubular components is shown in U.S. Pat. No. 5,012,891 which issued to Macaluso on May 7, 1991. The reversing or turn-around chamber of U.S. Pat. No. 5,012,891 is at one longitudinal end of the muffler and is defined by the external shell. In some instances this leads to excessive vibration of the external shell. Furthermore, U.S. Pat. No. 5,012,891 indicates that a resonating chamber or Helmholtz chamber is not intended for a muffler of the type disclosed therein, since excessive noise is considered an attribute to suggest "power". Other mufflers with stamped and conventional components are shown in Japanese Published Patent Application No. 2-207124; and Japanese Published Utility Model Applications No. 2-83324 and No. 2-83317. These references do not show tuning tubes and resonating chambers nor the traditional and often preferred tri-flow design. Furthermore, the conventional tubes disposed in the stamped chambers are perforated to achieve communication between the exhaust gas of the tube and the chamber. Japanese Published Patent Application No. 59-43456 shows a muffler with stamped components and conventional tubes, including a tuning tube and low frequency resonating chamber. However, the muffler shown in Japanese Published Patent Application No. 59-43456 does not include the tri-flow pattern that is desireable in many exhaust systems, and the chamber is at an off-line location in the muffler.

Substantial improvements in stamped muffler technology have been made in recent years. In particular, re-issue U.S. Pat. No. RE33,370 and reexamined U.S. Pat. No. 4,736,817 show mufflers formed entirely from stamped components and including at least one expansion chamber, at least one low frequency resonating chamber and tuning tube combination and/or a high frequency tuning chamber. Mufflers incorporating the teaching of re-issue U.S. Pat. No. RE33,370 and U.S. Pat. No. 4,736,817 achieve all of the functional and manufacturing advantages of stamped mufflers and are able to equal or exceed the performance of conventional mufflers. In view of the many advantages, the stamp formed mufflers shown in re-issue U.S. Pat. No. RE33,370 and U.S. Pat. No. 4,736,817 have achieved very substantial commercial success.

The assignee of re-issue U.S. Pat. No. RE33,370 and U.S. Pat. No. 4,736,817 is the assignee of the subject invention and has made other substantial improvements in stamped muffler technology. For example, U.S. Pat. No. 4,901,816 and U.S. Pat. No. 4,905,791 both issued to David Garey and show mufflers formed only from two stamped external shells and with the tail pipe and exhaust pipe of the system extending into the outer shell for contributing to the noise attenuation carried out by the muffler. More particularly, the outer shell is stamped to define baffles for supporting portions of the exhaust pipe and tail pipe disposed within the muffler. End regions of the exhaust pipe and tail pipe are provided with perforations or louvers to enable a controlled expansion of exhaust gas into certain of the chambers defined by the external shell. The muffler shown in U.S. Pat. No. 4,759,423 is light weight and offers several cost efficiencies. However, tuning options may be limited as compared to other mufflers developed by the assignee of the subject invention.

U.S. Pat. No. 4,759,423 issued to Harwood et al. on Jul. 26, 1988 and is assigned to the assignee of the subject invention. U.S. Pat. No. 4,759,423 shows a tri-flow muffler with a reversing chamber defined by an external shell and disposed at one end of the muffler. A tuning tube and low frequency resonating chamber are disposed at the opposed end of the muffler, but are not disposed for a "driven" tuning. The muffler shown in U.S. Pat. No. 4,759,423 is substantially identical to the muffler shown in the above referenced U.S. Pat. No. 5,012,891. However, U.S. Pat. No. 4,759,423 is effective in eliminating at least some of the low frequency noise that presumably is considered desireable in U.S. Pat. No. 5,012,891.

Many of the mufflers shown in the above-referenced patents that are assigned to the assignee of the subject application include baffle creases in the external shells to separate one chamber from another. In particular, the baffle creases in the external shell extend a sufficient depth for the base of the baffle crease to contact an opposed region of a stamp formed internal plate. Mufflers formed with baffle creases in the external shell necessarily require a drawing of substantial amounts of metallic material, and hence can increase the total amount of metal required for the external shell. It also has been suggested that baffle creases could create pockets in which corrosive materials could accumulate. This alleged potential for corrosion of stamp formed mufflers in the vicinity of baffle creases has not been observed in tests performed to date. However, there of course is a desire to avoid even a suggestion for such a problem. Furthermore, mufflers requiring plural low frequency resonating chambers with corresponding tuning tubes and with high frequency tuning chambers could lead to very complex draws of metal in the external shell that might be difficult to achieve without excessive stretching of the metal.

U.S. Pat. No. 5,004,069 issued to Van Blaircum et al. on Apr. 2, 1991 and also is assigned to the assignee of the subject application. U.S. Pat. No. 5,004,069 shows a muffler that employs a transversely aligned tube which functions as a baffle between chambers of the muffler. The use of a transverse baffle tube avoids the formation of a deeply drawn baffle crease in an external shell of a muffler. Although the muffler shown in U.S. Pat. No. 5,004,069 includes tuning tubes and low frequency resonating chambers, the design does not show placement of the tuning tubes and low frequency resonating chambers for achieving a "driven" tuning. U.S. Pat. No. 5,004,069 also does not show the tri-flow design which is desireable in many situations.

U.S. Pat. No. 4,860,853 issued to Walter G. Moring III on Aug. 29, 1989 and also is assigned to the assignee of the subject invention. U.S. Pat. No. 4,860,853 shows a muffler that achieves substantial cost and weight efficiencies in that it can be formed with only three stamped components. The muffler of U.S. Pat. No. 4,860,853 also avoids the formation of pockets on at least upwardly facing surfaces of the muffler. However, certain deep draws of metal may be required for at least certain embodiments of the muffler depicted in U.S. Pat. No. 4,860,853.

U.S. Pat. No. 4,847,965 issued to Harwood et al. on Jul. 18, 1989 and also is assigned to the assignee of the subject invention. U.S. Pat. No. 4,847,965 shows a method of manufacturing stamp formed mufflers where die inserts are employed in the stamping equipment to enable selective variations to be made in the stamp formed components to accommodate the needs of certain vehicles within a family of related vehicles and without employing an entirely new set of master dies. As a result, a system of mufflers may be formed having generally the same pattern of tubes therein, but with selected portions of tubes in one muffler being different from comparable sections in another muffler to enable the respective mufflers to perform slightly different acoustical functions.

Co-pending application Ser. No. 577,495 was filed on Sep. 4, 1990 by Michael Clegg et al. and shows a stamp formed muffler with flow tubes and in-line expansion chambers dimensioned to achieve expansion ratios that optimize noise attenuation.

The disclosures of the prior art patents and the pending application assigned to the assignee of the subject invention are incorporated herein by reference.

Still another prior art stamp formed muffler is shown in U.S. Pat. No. 5,012,891 which issued to Macaluso on May 7, 1991. U.S. Pat. No. 5,012,891 shows a muffler with opposed plates formed to define tubes and opposed pan shaped halves formed to define an outer shell surrounding the tubes. A conventional tube extends through a turn around or reversing chamber defined by the pan shaped halves and connects to the tubes formed by the plates. In one embodiment, exhaust gas entering the turn around chamber of U.S. Pat. No. 5,012,891 flows under and over the conventional tube while flowing toward the return tube, as had been the case with the typical prior art muffler 10 shown in FIG. 9. Also like the conventional muffler shown in FIG. 9, the turn around chamber of the muffler of U.S. Pat. No. 5,012,891 is defined by substantially parallel opposed walls which are substantially orthogonal to the plane defined by the connected plates.

Despite the many advantages in stamped muffler technology achieved by the assignee of the subject invention, there is a desire to further improve stamped mufflers. In particular, it is desired to substantially increase the tuning options available with stamped mufflers without necessarily complicating the individual stamped components and without creating large draws of metal in the external shell.

In view of the above, it is an object of the subject invention to provide a formed muffler that provides efficiently configured in-line flow tubes and in-line expansion chambers to reduce flow noise and back pressure.

It is another object of the subject invention to provide a formed muffler that avoids deep draws of metal and the creation of pockets in the external shells.

It is a further object of the subject invention to provide a formed muffler with at least one low frequency resonating chamber and at least one driven tuning tube.

Still a further object of the subject invention is to provide a family of related mufflers with certain members of the family having high frequency tuning capability.

Yet another object of the subject invention is to provide a tri-flow muffler with at least one driven tuning tube and low frequency resonating chamber.

An additional object of the subject invention is to provide a tri-flow muffler with a reversing chamber defined by internal plates and insulated from the external shell to avoid shell ring.

A further object of the invention is to provide a muffler that can achieve efficient tuning with only three formed components.

SUMMARY OF THE INVENTION

The subject invention is directed to a muffler having a pair of plates that are formed by stamping or other known forming technologies. The plates are formed to define an array of channels and at least one in-line expansion chamber. The channels are disposed to define an array of tubes when the plates are secured in face-to-face relationship with one another. The tubes defined between the plates may include at least one inlet, at least one outlet and a return tube for communication between the inlet and outlet. The tubes may further include at least one tuning tube. Selected tubes formed in the plates may include perforations, louvers, apertures and/or other means for providing communication from the tubes.

The in-line expansion chamber defined by the plates of the muffler is disposed to communicate with at least two of the tubes formed by the plates. The in-line expansion chamber may be internally disposed and thus insulated from the exterior of the muffler in embodiments where external shell vibration may be a problem. Unlike many prior art mufflers, opposed walls of the in-line expansion chamber are not parallel, and the walls do not extend orthogonally from the abutting surfaces of the plates. Rather opposed walls converge and may be arcuate. The in-line expansion chamber defined by the plates may also function as a reversing chamber. The plates may further be formed to define at least one additional chamber which may function as a high frequency tuning chamber, as explained herein.

The muffler further includes at least one external shell secured to at least one of the plates. The external shell is formed to define at least one external chamber surrounding at least selected formed portions of the plate to which the external shell is secured. More particularly, the external shell may include a peripheral portion securely affixed to peripheral regions of the adjacent plate. Additionally, a portion of the external shell may be formed to lie in face-to-face abutting contact with the chamber defined by the adjacent plate. Thus, the chamber defined by the plate of the muffler may also function as a baffle dividing the external shell into two functionally separate external chambers. One such external chamber defined in the external shell may enclose portions of tubes having perforations, louvers, apertures or the like, such that the external chamber functions as an expansion chamber into which the exhaust gas will expand. Another chamber defined by the external shell may communicate with a tuning tube, and hence may function as a low frequency resonating chamber or Helmholtz chamber with a volume selected to attenuate a particular range of low frequency noise. The low frequency resonating chamber and the expansion chamber defined by the external shell may be physically separated from one another by the chamber formed in the adjacent plate and may function entirely independently of one another. In one embodiment illustrated herein, the muffler may include a pair of external shells connected respectively to the plates of the muffler. At least selected chambers defined by one external shell may function independently from chambers defined in the opposed external shell. However, selected external chambers in the two external shells may function in unison with one another.

The muffler of the subject invention further includes a pipe disposed intermediate the plates of the muffler. The pipe within the muffler extends across at least one chamber defined by the plates of the muffler, and optionally may be a unitary extension of the exhaust pipe or tail pipe. The pipe is disposed in the in-line expansion chamber such that exhaust gas must flow on each side of the pipe while flowing between the two tubes communicating with the in-line expansion chamber. The disposition of the pipe and the configuration of the in-line expansion chamber are such that the portions of the chamber adjacent the pipe function as effective flow tubes. Additionally, portions of the in-line expansion chamber upstream and downstream from the pipe function as separate in-line expansion chambers. The arcuate shape of the pipe and the converging or arcuate shape of the chamber walls results in efficient noise attenuation and low back pressure as the exhaust gas flows through the in-line expansion chamber. The dimensions of the effective flow tubes on either side of the pipe are selected in view of the exhaust gas noise characteristics and noise attenuation requirements. In some embodiments, the chamber formed by the plates is configured to define effective flow tubes of different cross-sectional dimensions. Additionally, the pipe in the in-line expansion chamber may be non-round, with the particular shape being selected to enable the effective flow tubes to perform optimally.

If necessary for efficient tuning of the muffler a portion of pipe within the muffler, but spaced from the in-line expansion chamber may include an array of perforations to enable communication with a high frequency tuning chamber defined by the plates of the muffler. If the high frequency tuning chamber is not required on certain models of the muffler within a series of related mufflers, the pipe within the muffler may be formed without perforations, thereby rendering the high frequency tuning chamber inoperative without affecting other parts of the muffler. A high frequency tuning chamber may alternatively be provided by having a perforated or louvered pipe within an unperforated pipe. The outer unperforated pipe may be necked down to engage the inner perforated pipe, and the assembly of pipes may be disposed to bridge the in-line expansion chamber.

The muffler of the subject invention may be formed by initially welding or otherwise connecting the plates in face-to-face relationship to one another. The pipe in the muffler may be positioned before or after assembly of the plates. The external shells may then be affixed to the plates. Alternatively, the external shells may be affixed to the plates prior to insertion of the pipe into the muffler. The pipe may subsequently be inserted into the completed assembly of plates and external shells.

DETAILED DESCRIPTION OF THE PREFERRED EMBODIMENT

Figure 1:
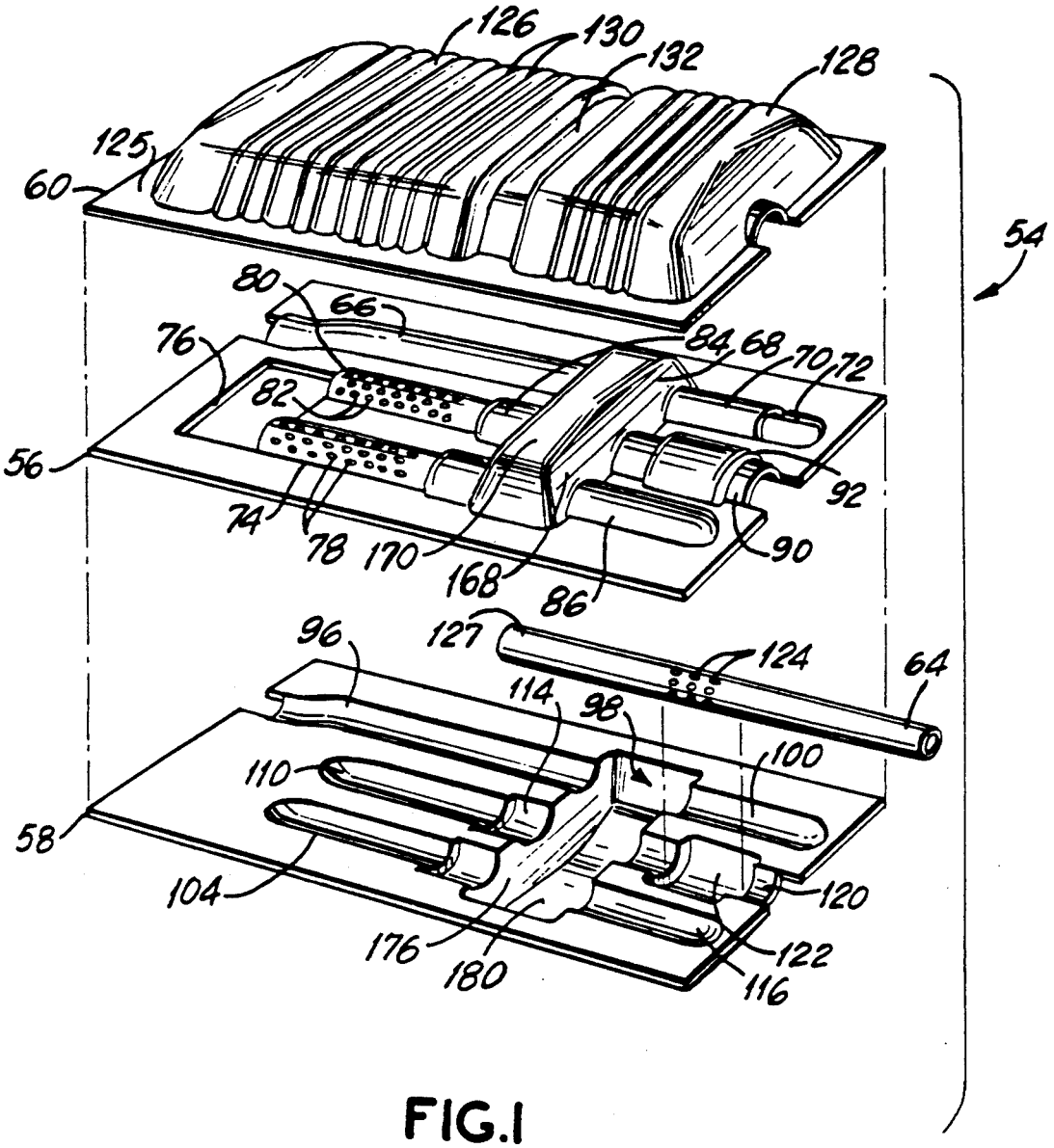
FIG. 1 is an exploded perspective view of a muffler in accordance with the subject invention.
Figure 2:
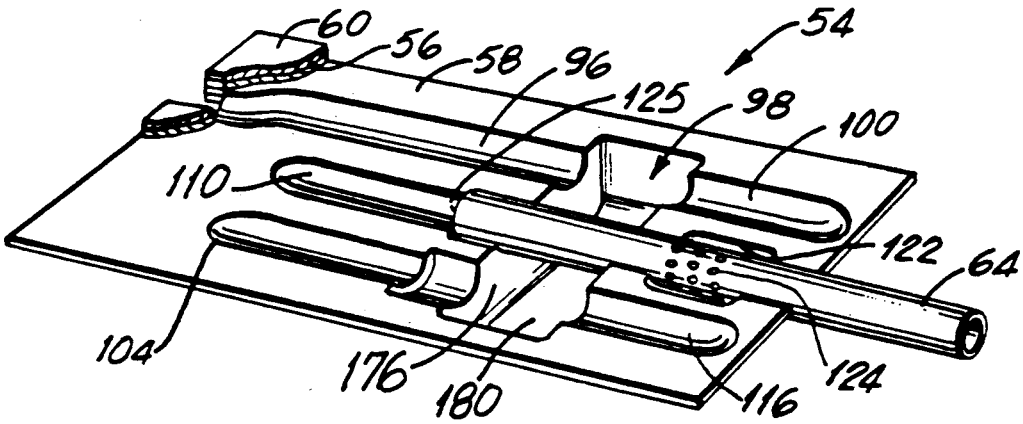
FIG. 2 is a perspective view, partly in section of the assembled muffler in accordance with the subject invention.
Figure 3:
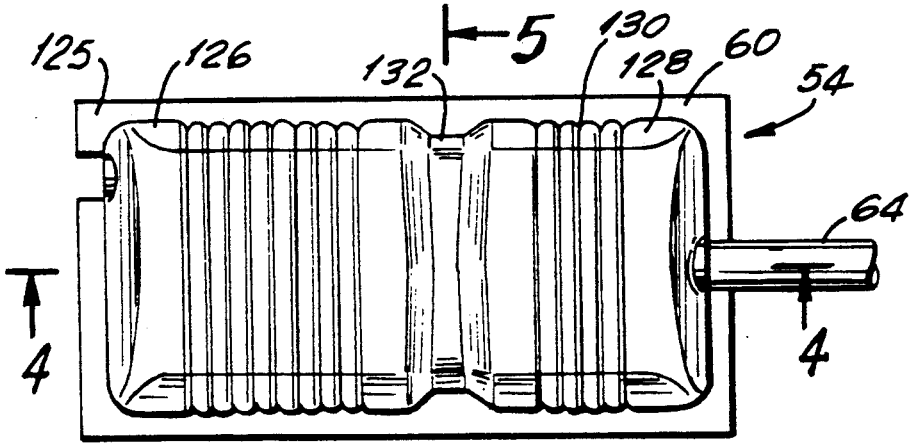
FIG. 3 is a top plan view of the assembled muffler.

The muffler of the subject invention is identified generally by the numeral 54 in FIGS. 1-5. The muffler 54 includes first and second plates 56 and 58 respectively, an external shell 60 and a pipe 64, which is shown as being a unitary part of the tail pipe. The plates 56 and 58 and the external shell 60 are stamped from unitary sheets of metal. However, as noted above, other metal formation techniques may be employed.

The first plate 56 is of substantially rectangular configuration, and is formed to include an array of channels and chambers extending from an otherwise planar sheet. It is to be understood, however, that non-rectangular and non-planar sheets may be employed. The first plate 56 includes an inlet channel 66 extending from a peripheral region of the first internal plate 56 to a chamber 68 which is disposed between the opposed ends of the plate 56. The chamber 68 includes converging ends walls 168 and 169 and a transverse wall 170 which extends between the converging end walls 168 and 169.

A tuning channel 70 communicates with the chamber 68 at a location substantially aligned with the inlet channel 66. The tuning channel 70 terminates at a tuning aperture 72 stamped into the first plate 56.

A first flow channel 74 extends from the chamber 68 to an expansion aperture 76 formed through the first plate 56. The first flow channel 74 is characterized by an array of perforations 78 extending therethrough. It is to be understood, however, that louvers, slots or other substantially equivalent communication means can be provided in place of the perforations 78 to enable expansion of exhaust gas from the channel 74. A second flow channel 80 extends from the expansion aperture 76 back to the chamber 68. The channel 80 is provided with an array of perforations 82 to enable communication with surrounding regions of the muffler. The portion of the second flow channel adjacent the chamber 68 defines an enlarged diameter pipe seat 84. A second tuning channel 86 extends from the chamber 68 in the first plate 56. The second tuning channel 86 is not provided with a tuning aperture comparable to the aperture 72.

An outlet channel 90 extends from the chamber 68 to a peripheral region of the first plate 56. The outlet channel 90 is characterized by an enlarged high frequency tuning chamber 92 intermediate the length of the outlet channel 90.

The second plate 58 is depicted as being a substantial mirror image of the first plate 56. However, such symmetry is not required. The second plate 58 includes an inlet channel 96 in register with the inlet channel 66 of the first plate 56. A chamber 98 in the second plate 58 is in communication with the inlet channel 96 and is substantially in register with the chamber 68 on the first plate 56. The chamber 98 is defined by converging end walls 176 and 178 and a transverse wall 180.

A tuning channel 100 extends from the chamber 98. The tuning channels 70 and 100 of the plates 56 and 58 will be substantially registered with one another and will be directly opposite the inlet tube defined by the channels 66 and 96. This alignment of the tuning channels 70, 100 with the inlet channels 66, 96 achieves a "driven" tuning which is considered very desirable in many situations. The length and cross-sectional dimensions of the tuning channels 70 and 100 will be selected in accordance with the specific low frequency sound to be attenuated. In the embodiment of the muffler 54 depicted herein the tuning tube defined by the channels 70 and 100 will communicate with a low frequency resonating chamber defined by portions of the external shell 60. In other embodiments the tuning channel 100 will include a tuning aperture to enable communication with a low frequency resonating chamber defined by a second external shell as explained and illustrated below.

The second plate 58 is further characterized by a first flow channel 104 extending from the chamber 98 to a location in register with the expansion aperture 76 in the second plate 56. A second flow channel 110 extends from a location in register with the expansion aperture 76 to the chamber 98. Portions of the second flow channel 110 in proximity to the chamber 98 are enlarged to define a pipe seat 114. A second tuning channel 116 is formed in the second plate 58 and extends from the chamber 98. The second tuning channel 116 is substantially free of apertures, and hence is substantially identical to the second tuning channel 86 of the first internal plate 56. Thus, the tuning tube formed by the tuning channels 86 and 116 will perform only a modest tuning function. In other embodiments, as explained below, a tuning aperture may be formed in the second tuning channel 116. With this later embodiment, the tuning tube defined by the channels 86 and 116 will communicate through the tuning aperture in the second plate 58 to a low frequency resonating chamber defined by a second external shell.

An outlet channel 120 extends from the chamber 98 to a peripheral region of the second plate 58. The outlet channel 120 is characterized by a high frequency tuning chamber 122 intermediate the length of the outlet channel 120.

The external shell 60 includes a generally planar peripheral flange 125 which is dimensioned to substantially register with peripheral regions of the first plate 56. The external shell 60 is stamped to include an expansion chamber 126 and a low frequency resonating chamber 128 which are formed to extend from the plane defined by the peripheral flange 125. The expansion chamber 126 and the low frequency resonating chamber 128 are characterized by reinforcing grooves 130 formed therein to prevent excessive vibration of the first external shell 60 in response to the flowing of exhaust gas through the muffler 54. An attachment region 132 is defined intermediate the expansion chamber 126 and the low frequency resonating chamber 128. The attachment region 132 is disposed and dimensioned to be in substantially face-to-face relationship with the transverse wall 170 of the chamber 68 formed in the first plate 56.

The pipe 64 is depicted as being of conventional circular cross-section. Although an arcuate cross-section is preferred, the illustrated circular cross-section is not essential, and noncircular cross-section may be preferred in some embodiments. The pipe 64 is provided with an array of perforations 124 at locations thereon spaced from the end 127 of the pipe 64 in the embodiment depicted in FIGS. 1 and 2. The external cross-section of the pipe 64 conforms to the cross-section of the pipe seat 84, 114 and the cross-section of the outlet tube 90, 120. The internal cross-section of the pipe 64 conforms to the cross-section of the second flow tube 80, 110 to avoid turbulence and back pressure as explained above.

The muffler 54 is assembled as shown most clearly in FIGS. 2–5. In particular, the end 127 of the pipe 64 is disposed in the seat defined by regions 84 and 114 of the respective second flow channels 80 and 110 of the first and second plates 56 and 58. The portion of the pipe 64 extending across the chamber 68, 98 is substantially free of perforations or other communication means. However, on the embodiment depicted in FIGS. 1, 2 and 4, the array of perforations 124 is disposed to register with the high frequency tuning chambers 92 and 122. Planar regions of the first and second plates 56 and 58 are securely affixed to one another at a plurality of selected locations about the muffler 54. The external shell 60 then is securely affixed to peripheral regions of the first plate 56. With this construction, the attachment region 132 of the external shell 60 is secured in abutting face-to-face contact with the transverse walls 170 of the chamber 68. This face-to-face disposition of the attachment regions 132 with the chamber 68 may be welded to prevent vibration related noise therebetween, and to reinforce the walls of the internally disposed reversing chamber 68, 98. The peripheral flange 125 of the external shell 60 may also be welded or mechanically connected to the plate 56.

Figure 4:
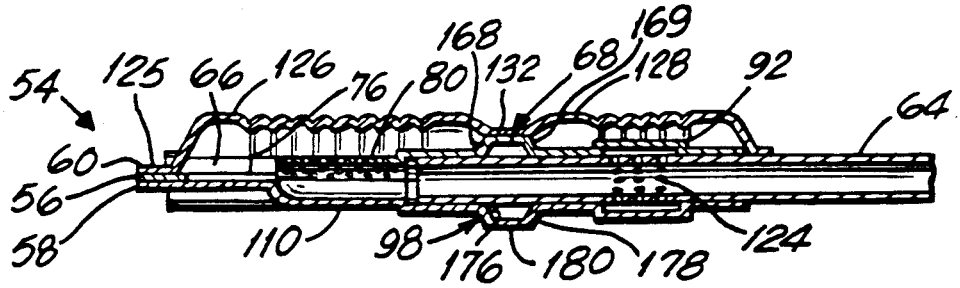
FIG. 4 is a cross-sectional view taken along line 4—4 in FIG. 3.
Figure 5:
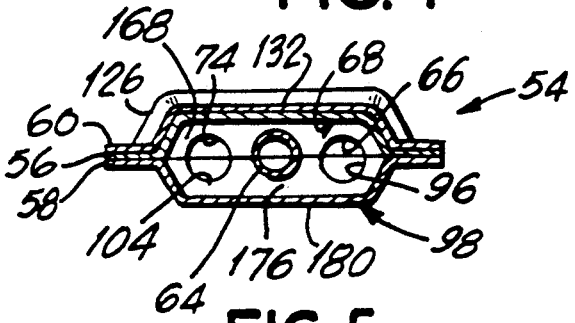
FIG. 5 is a cross-sectional view taken along line 5—5 in FIG. 3.

With this construction, as shown most clearly in FIGS. 4 and 5, an effective flow tube 172, 182 is defined where the converging end walls 168, 169, 176 and 178 and the transverse walls 170 and 180 pass in proximity to the pipe 64. With reference of FIG. 4, the effective flow tubes 172, 182 have generally arcuate cross-sectional shapes, and as shown in FIG. 5, the circular or arcuate pipe 64 defines smoothly arcuate converging entries to the effective flow tube 172 and 182, and similar diverging exits therefrom. The portion 174 of the chamber 68, 98 downstream from the effective flow tubes 172, 182 defines an in-line expansion chamber. The dimensions of the effective flow tubes 172, 182 and the in-line expansion chamber 174 are selected to achieve an expansion ratio with optimum attenuation. The dimensions of the effective flow tubes 172 and 182 may be different from one another in length or cross-section.

In the embodiment shown in FIGS. 1–4, exhaust gas will enter the muffler 54 in the inlet tube defined by the opposed registered channels 66 and 96. The exhaust gas will continue to flow into the in-line expansion chamber 68, 98 of the first and second plates 56 and 58 respectively. The exhaust gas will then enter the effective flow tubes 172 and 182 and will expand into the downstream portion 174 of the in-line expansion chamber 68, 98. The tapered or arcuate cross-section shape of the effective flow tubes 172 and 182 and the above described and illustrated entry and exit configurations for the effective flow tubes 172 and 182 achieves a very low back pressure. The dimensions of the effective flow tubes 172 and 182 and the portion 174 of the in-line expansion chamber 68 are selected to achieve an expansion ratio that will optimize the attenuation of noise. For example, an expansion ration of 12:1 has been found to be effective. The exhaust gas will undergo a 180° change of direction in the in-line expansion chamber 68, 98 to flow into the first flow tube 74, 104. The gas then will expand into the expansion chamber 126 defined by the external shell 60. The expansion into the chamber 126 will be achieved both through the perforations 78, and through the expansion aperture 76. The exhaust gas will continue to flow from the expansion chamber 126 and into the second flow tube defined by the channels 80 and 110. The exhaust gas will then enter the pipe 64 at the end 127 thereof, and will flow continuously across the in-line expansion chamber 68, 98 without expansion and toward the outlet of the muffler 54. At least selected embodiments will be provided with the perforations 124 in the pipe 64 to enable communication with the high frequency tuning chamber 92, 122 defined in the plates 56 and 58.

Low frequency tuning of the muffler 54 can be varied in accordance with the tuning requirements of the particular engine with which the muffler 54 is employed. A primary low frequency tuning function will be achieved by the tuning channels 70 and 100 which are aligned with the inlet tubes 66, 96. As explained above, this alignment of the tuning tube 70, 100 with the inlet tube 66, 96 achieves a driven tuning which is considered to be highly effective. The length and cross-sectional dimensions of the tuning tube defined by the channels 70 and 100 are factors in determining the frequency of the low frequency noise to be attenuated. Another factor is the volume of the low frequency resonating chamber 128 defined by the eternal shell 60.

Figure 6:
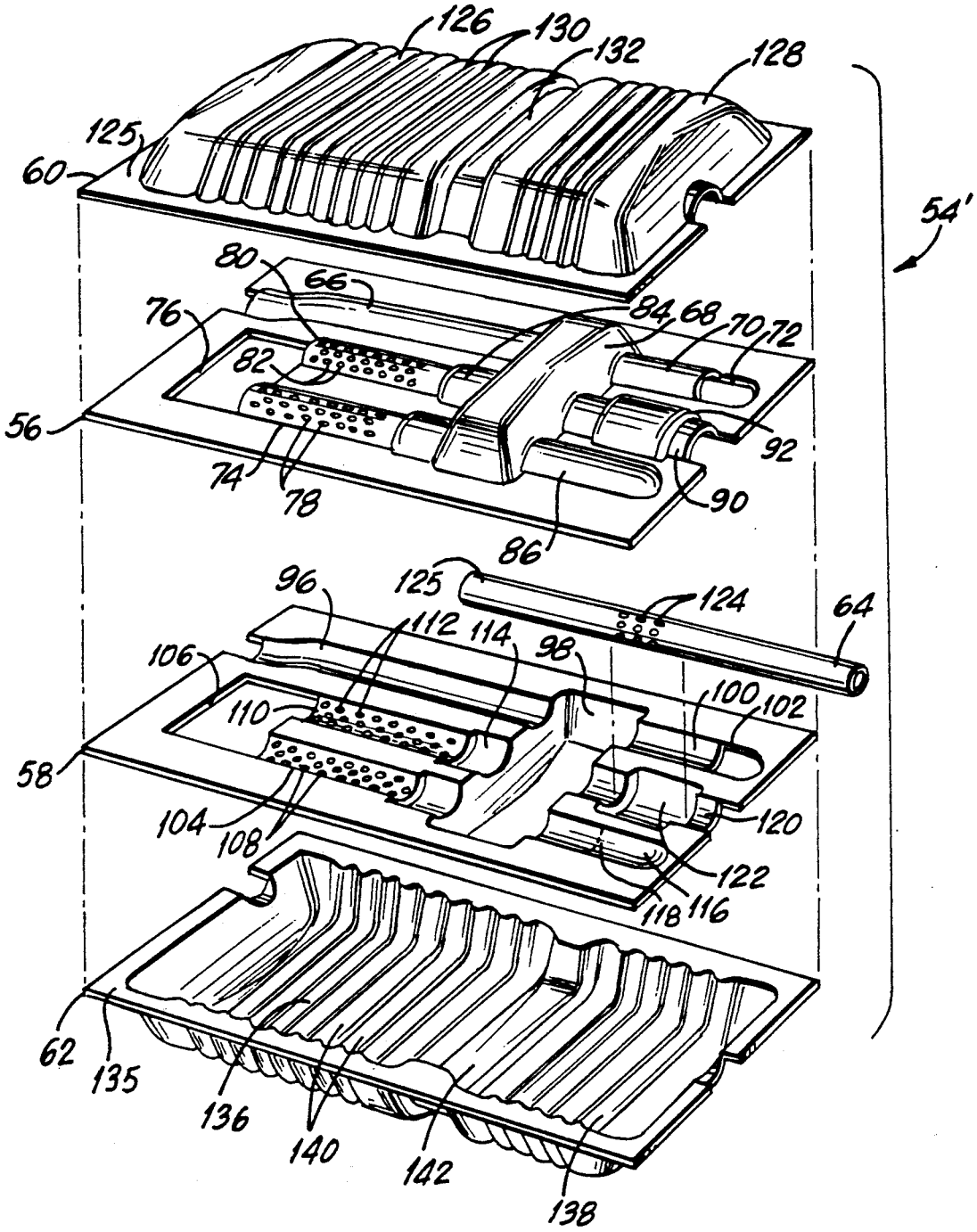
FIG. 6 is an exploded perspective view of a second embodiment of the muffler of FIGS. 1-5.

An alternate embodiment of the muffler 54 is illustrated in FIG. 6 and is identified generally by the numeral 54'. The muffler 54' includes a plate 56 substantially identical to the plate 56 shown in FIGS. 1–5. The muffler 54' further includes a second plate 58' substantially similar to the plate 58' shown in FIGS. 1–5. However, the plate 58' includes an expansion aperture 106 disposed substantially in register with the expansion aperture 76 in the first plate 56. Additionally, the flow tube 104 is provided with an array of perforations 108, and the flow tube 110 is provided with an array of perforations 112. Additionally, the tuning tube 116 is provided with a tuning aperture 118.

The muffler 54' further includes a second external shell 62 which, in the embodiment shown in FIG. 6, is substantially a mirror image of the first external shell 60. In particular, the second external shell 62 includes a generally planar peripheral flange 135 dimensioned to be placed in register with peripheral regions of the second plate 58'. The second external shell 62 further is formed to include an expansion chamber 136 disposed to surround and communicate with the expansion aperture 106 and the perforations 108 and 112 in the second plate 58'. The second external shell 62 further includes a low frequency resonating chamber 138 disposed and dimensioned to surround the tuning aperture 118 in the tuning tube 116. An array of reinforcing grooves 140 is disposed in the second external shell to prevent or minimize shell. An attachment region 142 is disposed intermediate the second expansion chamber 136 and the second low frequency resonating chamber 138, and is disposed for secure engagement against the second in-line expansion chamber 98 of the second plate 58'.

The muffler 54' as shown in FIG. 6 provides several acoustical tuning options that are not present in the muffler 54. In particular, two low frequency resonating chambers that can be tuned to two distinct frequencies can be provided. Additionally, a much larger expansion volume is provided by the combined expansion chambers 126 and 136. Additionally, in the muffler 54 prime shown in FIG. 6, the portion of the in-line expansion chamber 98 is more effectively insulated from the exterior of the muffler, and hence can provide more effective dampening of vibrations and elimination of associated shell ring.

The mufflers 54 and 54' provide several very significant advantages. First, the external shell is formed without extensive deep draws that require excessive metal, excessive deformation and which arguably could enable accumulation of corrosive materials. Second, the mufflers 54 and 54' provide substantial flexibility in varying mufflers to meet the specific acoustical tuning needs of specific vehicle types within a broad class of similar vehicles. In particular, the muffler readily could be provided with at least two tuning tubes communicating with a corresponding number of separate low frequency resonating chambers. High frequency tuning also can be provided by merely perforating a portion of the tube 64 to enable communication with the high frequency tuning chamber defined in the internal plates. Additionally, the mufflers 54 and 54' provide flow patterns that are used in many conventional mufflers employing wrapped outer shells and separate baffles. This tri-flow pattern is achieved with three or four stamped components by extending the pipe 64 without perforations through the in-line expansion chamber 68, 98. The in-line expansion chamber 68, 98, which is subjected to substantial forces by the reversing flow of exhaust gas, is defined entirely by the plates 56, 58, and in the embodiment of FIG. 6 is insulated from the external shell by the expansion chamber 126, 136 and the low frequency resonating chamber 128, 138. Importantly, the walls of the chamber 68, 98 in proximity to the pipe 64 are efficiently shaped to effectively defined flow-tubes leading to a downstream in-line expansion chamber. The dimensions of the internal chamber are selected to achieve a high expansion ratio, and hence significant attenuation without a high back pressure. Furthermore, the chambers in which expansion and changes of direction of exhaust gas occur are substantially free of abrupt edges and right angle corners, and hence significantly reduce generation of "flow noise".

Figure 7:
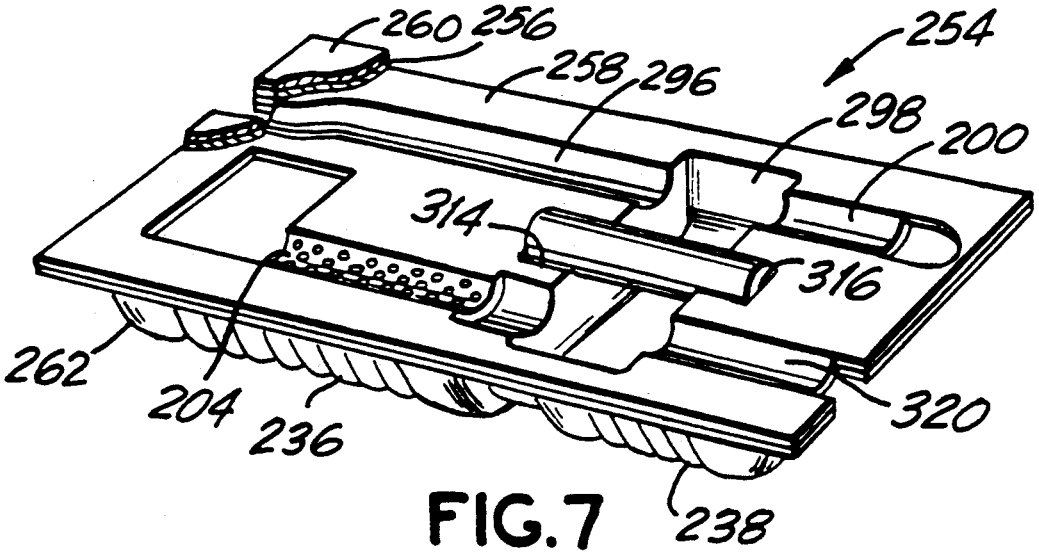
FIG. 7 is a perspective view, partly in section, of a third embodiment of a muffler in accordance with the subject invention.

FIG. 7 shows a muffler 254 that is a variation of the muffler 54 illustrated and described above. In particular, the muffler 254 includes first and second internal plates 256 and 258 and first and second external shells 260 and 262 that are similar to the comparable components in FIGS. 1–5. However, the muffler 254 in FIG. 6 is constructed for a "side in - side out" application and with a substantially more direct flow path. In particular, the internal plate 258 includes an inlet channel 296 leading to an internal chamber 298. An outlet channel 320 extends from the internal chamber 298 to a peripheral location on the muffler. The internal plate 258 is configured to define pipe seats 314 and 316 on opposite respective ends of the internal chamber 298 and intermediate the inlet channel 296 and the outlet channel 320. Thus, exhaust gas flowing from the inlet channel 296 to the outlet channel 320 will enter the internal chamber 298, will flow on opposite respective sides of the pipe 264 and will continue to the outlet channel 320. The exhaust gas will expand initially upon entry into the internal chamber 298 and again upon passing through the effective flow tubes defined in the internal chamber 298 on opposite respective sides of the pipe 264. As noted above, this expansion of exhaust gas in the internal chamber 298 is very effective in attenuating noise. Additional attenuation can be achieved, for example, by the tubes 200 and 204 and by the external chambers 236 and 238. The tubes and the chambers can be constructed to communicate with one another by means of the pipe 264. Thus, a substantially larger area of exhaust gas expansion can be achieved. Alternatively, one or both ends of the pipe 264 may be closed such that the external chambers 236 and 238 function as low frequency resonating chambers as described above.

Figure 8:
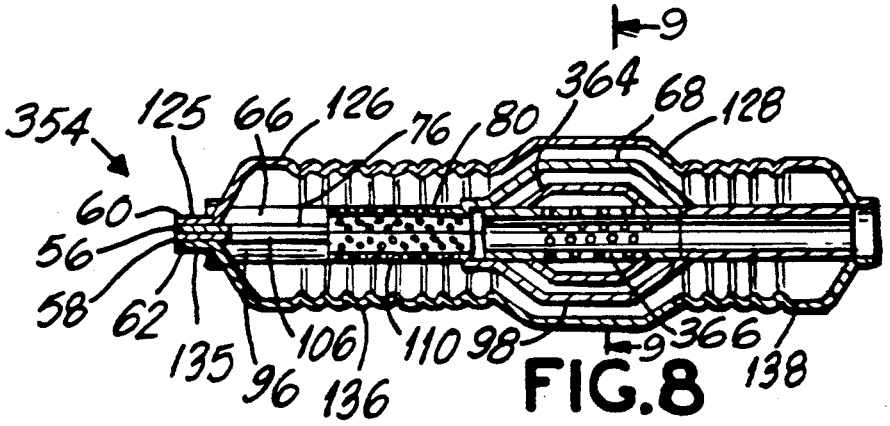
FIG. 8 is a cross-sectional view similar to FIG. 4 showing a fourth embodiment of a muffler in accordance with the subject invention.
Figure 9:
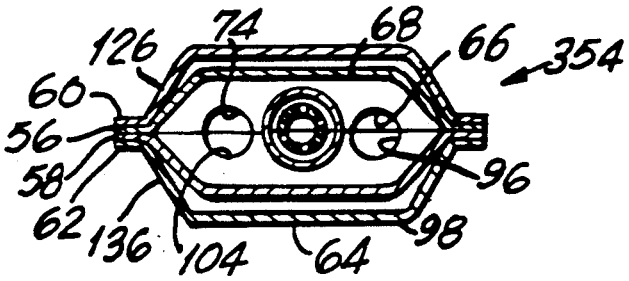
FIG. 9 is a cross-sectional view taken along line 9—9 in FIG. 8.
Figure 10:
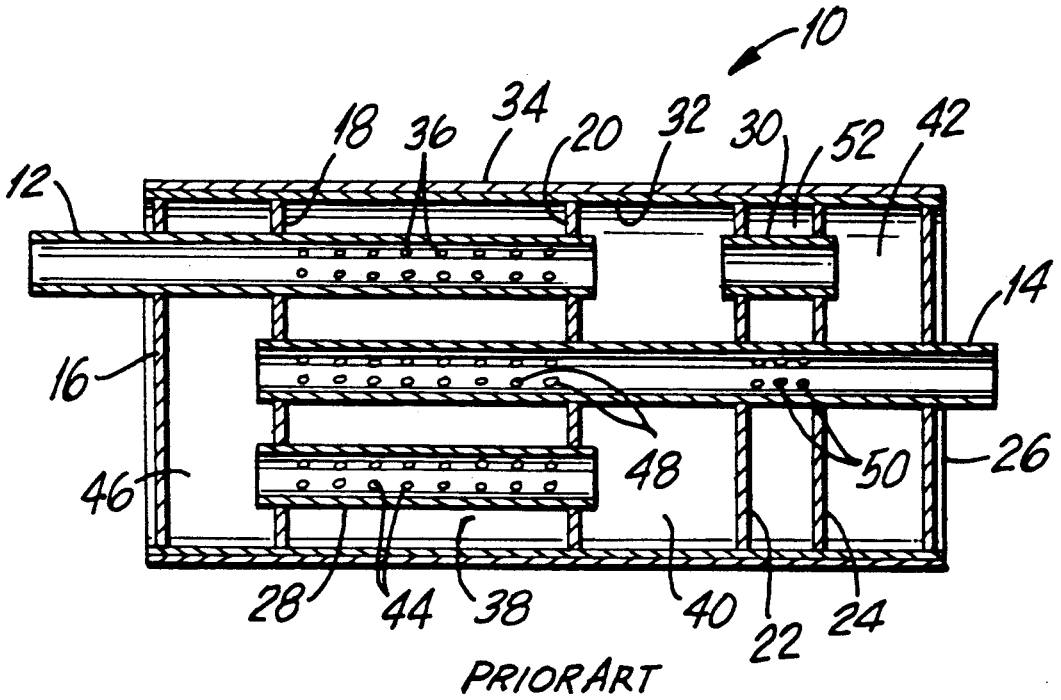
PRIOR ART FIG. 10
FIG. 10 is a cross-sectional view of a prior art muffler.

FIGS. 8 and 9 show another alternate embodiment of the muffler 54 depicted in FIGS. 1–5. In particular, a muffler 354 shown in FIGS. 8 and 9 is substantially identical to the muffler 54 shown in FIGS. 1–5 with a few minor exceptions. First, the external shells 60 and 62 do not directly contact the internal chambers 68 and 98. Thus, the entire external shell functions as a single large expansion chamber. Second, as shown in FIG. 9, the unperforated pipe 364 is not of circular cross-section, but rather is of a non-circular arcuate cross-section. As noted above, the particular cross-sectional shape will be selected in accordance with the tuning requirement and the preferred expansion ratio for the muffler. Third, the muffler 354 includes a perforated pipe 366 within the unperforated pipe 364. The unperforated pipe 364 is necked down into engagement with the perforated pipe 366 as shown in FIG. 8. Thus, the unperforated pipe functions as a high-frequency tuning chamber which communicates with the exhaust gas flowing through the perforated pipe 366.

While the invention has been described with respect to a preferred embodiment, it is apparent that various changes can be made without departing from the scope of the invention as defined by the appended claims. In particular, the components may be formed by processes other than stamping. Additionally, the communication means may take many other forms, including louvers, slots or the like. Furthermore, the relative dimensions and shapes of the components can vary significantly in accordance with the space available on the vehicle and the tuning requirements of the engine.

I claim:

1. An exhaust muffler for a vehicle comprising:

first and second plates secured in face-to-face relationship and formed to define an array of tubes and an in-line chamber, said chamber being defined by a plurality of converging arcuate surfaces formed in the plates, said array of tubes comprising an inlet tube extending from a peripheral location on the plates to the chamber, an outlet tube extending from said chamber to a second peripheral location on said plates, communication means formed through the first plate for permitting expansion of exhaust gas from the array of tubes;

an external shell formed to define a peripheral flange secured to the first plate, the external shell being formed to define at least one external chamber surrounding the in-line expansion chamber and the communication means in the first plate; and an unperforated pipe of arcuate cross-section disposed between the plates and extending across the in-line expansion chamber such that exhaust gas flowing through the chamber passes on opposed sides of the unperforated pipe, whereby the converging arcuate surfaces of the internal chamber define effective flow tubes in the in-line expansion chamber and adjacent the unperforated pipe for enabling efficient expansion of exhaust gas and low back pressure in the in-line expansion chamber.

2. An exhaust muffler as in claim 1, wherein the array of tubes further comprises at least one tuning tube, said tuning tube being provided with a tuning aperture formed through said first plate, at least one chamber defined by the external shell comprising a low frequency resonating chamber surrounding the tuning aperture.

3. An exhaust muffler as in claim 2, wherein the tuning tube extends from the internal chamber at a location substantially aligned with the inlet tube.

4. An exhaust muffler as in claim 1 wherein the external shell defines a first external shell, and wherein the muffler further comprises a second external shell having a peripheral flange secured to the second plate, the second external shell being formed to define at least one external chamber surrounding the in-line expansion chamber and the communication means in the second plate.

5. An exhaust muffler as in claim 1, wherein the array of tubes comprises a first flow tube extending from the in-line expansion chamber and a second flow tube communicating with the first flow tube and with the pipe, the pipe further communicating with the outlet tube and being disposed in the in-line expansion chamber between the inlet tube and the first flow tube.

6. An exhaust muffler as in claim 5, wherein the first and second flow tubes and the inlet tube each are provided with the communication means extending therethrough for enabling the expansion of exhaust gas therefrom.

7. An exhaust muffler as in claim 5, wherein the pipe extends entirely through the outlet tube formed by the internal plates to a location external of the muffler.

8. An exhaust muffler as in claim 5, wherein the plates are formed to define a high frequency tuning chamber spaced from the in-line expansion chamber, portions of the pipe extending through the high frequency tuning chamber including perforation means for communication with the high frequency tuning chamber.

9. An exhaust muffler as in claim 5, further comprising a perforated pipe disposed within the unperforated pipe, such that the unperforated pipe defines a high frequency tuning chamber.

10. An exhaust muffler as in claim 1, wherein the pipe is of circular cross-section.

11. An exhaust muffler as in claim 1, wherein said external shell defines a pair of external chambers separated from one another by the internal chamber.

12. An exhaust muffler as in claim 1, wherein the effective flow tubes defined adjacent the pipe are of different cross-sectional dimensions.

13. An exhaust muffler as in claim 1, wherein the internal chambers are securely affixed to opposed portions of the external shells.

14. A generally rectangular exhaust muffler for a vehicle, said muffler having opposed first and second generally parallel sides and opposed generally parallel first end second ends extending between the sides, said muffler comprising:

first and second internal plates secured in face-to-face relationship with one another and formed to define an array of tubes and a reversing chamber therebetween, said reversing chamber being of generally elongated configuration and having a longitudinal axis extending generally parallel to the ends of the muffler, the reversing chamber being defined by arcuately converging formed portions of the internal plates, the array of tubes comprising an inlet tube extending from the first end of the muffler to the reversing chamber, a first flow tube extending from the reversing chamber toward the first end of the muffler, a second flow tube communicating with the first flow tube and extending to the reversing chamber at a location intermediate the inlet tube and the first flow tube, the inlet tube and the first and second flow tubes being provided with communication means to permit expansion of exhaust gas therefrom, an outlet tube extending from the reversing chamber to the second end of the muffler, and a tuning tube extending from the reversing chamber and terminating at a tuning aperture formed through one said internal plate at a location intermediate the reversing chamber and the second end of the muffler;

a pipe of arcuate cross-section extending across the reversing chamber from the second flow tube to the outlet tube, sections of the pipe disposed in the reversing chamber being free of perforations such that the pipe provides communication from the second flow tube to the outlet tube without communication to the reversing chamber, and such that effective flow tubes of arcuate cross-section are defined in the reversing chamber in proximity to the pipe; and first and second external shells formed to define peripheral flanges secured to peripheral regions of the respective first and second internal plates, the external shells being formed to define attachment regions extending from the first side of the muffler to the second side of the muffler and secured to the reversing chambers formed in the first and second internal plates, the external shells further defining expansion chambers intermediate the first end of the muffler and the reversing chamber, the expansion chambers surrounding the communication means in the inlet tube and the first and second flow tubes of the internal plates, the external shells further defining a low frequency resonating chamber between the second end of the muffler and the reversing chamber, the low frequency resonating chamber surrounding the tuning aperture.

* * * * *